United States Patent [19]

McIlquham

[11] Patent Number: 5,005,215

[45] Date of Patent: Apr. 9, 1991

[54] PROTECTIVE ARTICLE OF CLOTHING

[76] Inventor: Carl J. McIlquham, W5836 Highway 64, Bryant, Wis. 54418

[21] Appl. No.: 435,094

[22] Filed: Nov. 9, 1989

[51] Int. Cl.[5] ..... A41D 17/02

[52] U.S. Cl. ..... 2/22; 2/4; 36/2 R; 119/156

[58] Field of Search ..... 2/22, 16, 4, 23, 269; 36/1.5, 2 R; 119/156, 106

[56] References Cited

U.S. PATENT DOCUMENTS

| | | | |
|---|---|---|---|
| Re. 32,506 | 9/1987 | Hightower, Jr. . | |
| 1,643,620 | 9/1927 | Dilger | 36/2 R |
| 2,205,711 | 6/1940 | Banks . | |
| 2,344,811 | 3/1944 | Gill . | |
| 3,191,185 | 6/1965 | Martin . | |
| 3,269,036 | 8/1966 | Parker et al. . | |
| 3,618,232 | 11/1971 | Shnoriwsky | 36/1.5 |
| 3,758,963 | 9/1973 | Knight | 36/2 R |
| 3,783,451 | 1/1974 | Malin | 2/4 |
| 3,808,339 | 4/1974 | Bordenca | 2/4 |
| 4,047,505 | 9/1977 | McAndless | 119/156 |
| 4,287,608 | 9/1981 | Meyer | 2/16 |
| 4,355,599 | 10/1982 | Fickes et al. | 119/106 |
| 4,422,184 | 12/1983 | Myers | 2/4 |
| 4,497,070 | 2/1985 | Cho | 2/22 |
| 4,542,597 | 9/1985 | Baptista et al. . | |
| 4,631,753 | 12/1986 | Ehring | 2/269 |
| 4,685,152 | 8/1987 | Heare | 2/4 |
| 4,716,594 | 1/1988 | Shannon | 2/4 |
| 4,856,112 | 8/1989 | Effle | 2/16 |

*Primary Examiner*—William A. Cuchlinski, Jr.
*Assistant Examiner*—C. W. Fulton
*Attorney, Agent, or Firm*—Quarles & Brady

[57] ABSTRACT

An article of clothing is disclosed that is designed to protect a user from ticks, other arachnids and crawling insects. The article of clothing can be in the form of a chap that encircles the leg of the user. Ties near the top of the chap support the chap on the user's belt. The chap material is sewn to create a circumferential flap, preferably near the top of the chap. An impervious strip encircles the chap just below the flap. A narrower absorbent strip is sewn onto the impervious strip. Tick repellent may be applied to the absorption strip, and the impervious strip prevents the repellent from soaking through to the chap material and the user's clothing. The flap tends to hang downward to shield the absorbent strip. A hem at the bottom draws the chap material around the leg of the user.

9 Claims, 1 Drawing Sheet

PROTECTIVE ARTICLE OF CLOTHING

BACKGROUND OF THE INVENTION

The invention relates to protective articles of clothing. More particularly, the invention pertains to articles of clothing such as leggings or shirts that are adapted to protect the user from contact with ticks, other arachnids and crawling insects.

Articles of clothing have been designed to protect a person from insects and animals, as well as providing the user with the normal protection from the weather. One frequent objective of such clothing is to protect the user from the bite of animals such as snakes (see e.g., U.S. Pat. Nos. 3,191,185 and 3,269,036). Protective clothing has also been designed to shield the user from flying insects (see e.g., U.S. Pat. No. 2,344,811). Disease-carrying ticks present a relatively new problem, however, for which current forms of clothing do not provide adequate protection.

Ticks are parasitic creatures which sometimes carry infectious diseases. Deer and bear ticks are known to carry *Borrelia burgdorferi* bacteria, which causes Lyme disease. Ticks can bite humans and in doing so, may transmit the bacteria. The tick problem has become substantial, as shown by the fact that Lyme disease has been discovered in 43 states and on every continent except Antarctica.

There are several chemical tick repellents which are commercially available. One form of repellant may contain a small percentage of the chemical DEET and often is applied directly to the user's skin. Many individuals may prefer, however, not to apply such chemicals directly to themselves due to the potential for harmful side affects. Still other individuals may be unable to apply the chemicals to their skin because of allergic reactions or skin irritations. For these reasons, some people use repellents only on their clothing and not on their skin.

One currently available repellent that is designed to be used only on clothing is a permethrin spray. For people who wish to apply repellent to their clothes, total application to standard types of clothing is not very practical. One reason is that a large quantity of repellent must be applied to cover all of the user's clothing. Another reason is that a general application exposes the repellent to weather (wind, rain, etc.) and physical objects (furniture, work tool, trees, etc.) which dissipate the repellent and thus diminish its effectiveness.

Thus, a need exists for a protective article of clothing that provides the user with protection from ticks by incorporating a design that (1) effectively diminishes the chances of ticks coming in direct contact with the user's skin, and (2) effectively receives and utilizes tick repellent.

SUMMARY OF THE INVENTION

The present invention provides an article of clothing that is designed to protect against contact with ticks. The protective clothing is formed of a sheet of fabric that is adapted to cover a portion of a user's body. The sheet of fabric generally has a top portion and an opposite bottom portion. Adjacent the bottom portion, the sheet of fabric is drawn around the user's body (wrists ande ankles). The protective clothing also includes a way to maintain the sheet of fabric on the portion of the body. An absorbent strip is attached circumferentially on the sheet of fabric between the top and bottom portions. This aspect of the invention provides an article of clothing that is designed to receive tick repellent in one localized area, over which ticks would pass if they were crawling on the clothing.

In another aspect of the invention, the sheet of fabric has a circumferential flap located between the top and bottom portions. Preferably, the absorbant strip is positioned below the flap, so that the flap is normally positioned outward of the absorbant strip. The flap thus shields the absorbant strip from the weather and from contact with the user's hands, wrists and other objects. The flap also inhibits normal upward movement of ticks on the sheet of fabric, and increases the time that ticks are likely to be in contact with repellent on the absorbant strip.

In another aspect, an impervious strip is attached circumferentially on the sheet of fabric between the sheet of fabric and the absorbant strip. This advantageously prevents repellent which may be applied to the absorbant strip from seeping through to the sheet of fabric or to the user's normal clothing.

Thus, it is an object of the present invention to provide an article of clothing that is designed to protect the user from ticks which spread Lyme disease, by making effective use of tick repellent that is applied to the protective clothing.

It is another object of the invention to provide an article of clothing that shields against exposure to ticks for people who desire not to apply tick repellents directly to their skin.

It is another object of the invention to provide an article of clothing that is designed to protect the user from ticks by hindering the movement of the ticks and maximizing the ticks exposure to a repellent.

It is another object of the invention to provide an article of clothing which will impede the upward movement of ticks, thus minimizing the chances of the user's skin coming in contact with ticks without the use of repellents.

It is still another object of the invention to provide an article of clothing that incorporates a surface which is designed to aid the user in locating ticks.

The foregoing and other objects and advantages of the invention will be evident from the following description. In the description, reference is made to the accompanying drawings which form a part hereof, and in which there is shown by way of illustration of a preferred embodiment of the invention. Such embodiment does not represent the full scope of the invention. Reference is therefore made to the claims herein for interpreting the scope of the invention.

DETAILED DESCRIPTION OF THE PREFERRED EMBODIMENT

Figure 1:
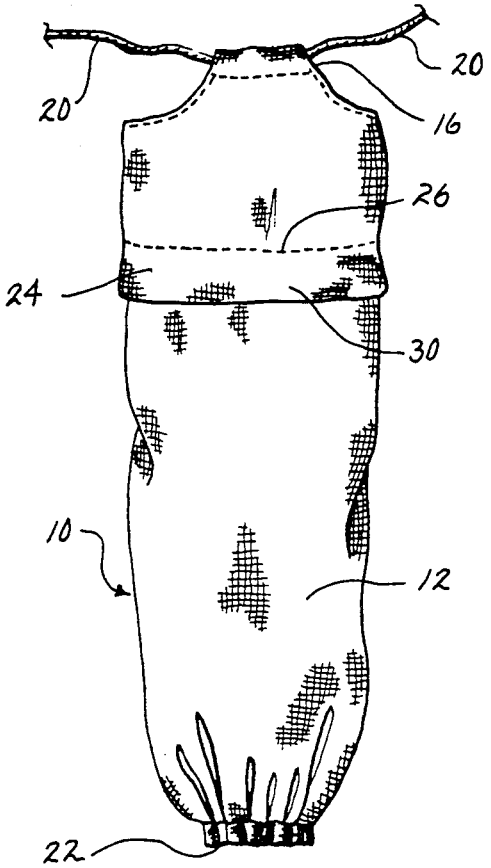
FIG. 1 is a front view in elevation of a protective article of clothing according the present invention.
Figure 2:
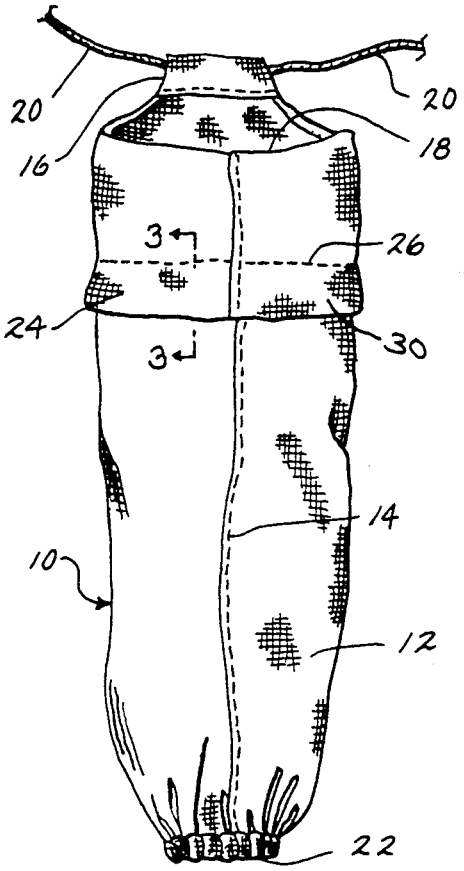
FIG. 2 is a rear view in elevation of the protective article of clothing shown in FIG. 1.

A protective article of clothing in the form of a tick chap 10 is shown in FIGS. 1 and 2 according to the present invention. The chap 10 includes a contoured sheet of fabric 12 that is sewn together at seam 14 (FIG. 2). The material 12 can be a variety of fabrics, but it is desirable that the material be of a smooth texture (e.g., a tightly woven nylone). Smooth fabrics tend to be slippery and therefore difficult for a tick to grasp. The material 12 is also preferably formed of a bright or light colored fabric. The wearer can then more easily observe ticks on the chap 10, and then remove the tick.

FIGS. 1 and 2 show front and rear views of a single chap 10 designed to encircle and protect the leg of a user from exposure to ticks, other arachnids and crawling insects. In use, the user would cover each leg with a chap 10. The material 12 is sized and designed to fit comfortably around the leg of the user, while providing sufficient space within the chap 10 for movement. The chap 10 must provide sufficient room to enable flexibility in the user's knee area. Sewn seam 14 insures that ticks cannot crawl through an opening in the chap 10 and reach the user.

The top of the chap material 12 is designed with an attachment section 16 in the front and a recessed area 18 (FIG. 2) in the rear. This design allows the chap 10 to cover the entire leg of the user and comfortably extend up to the crotch area of the user. Ties 20 are sewn to the attachment section 16 and are used to support the chap by attachment to the belt or belt loops of the user. Other types of fasteners, such as snaps or Velcro, could also be used in place of the ties 20. The chaps 10 could alternatively be supported from the shoulder of the user by employing a modified form of suspenders.

The bottom of the chap 10 is formed with a hem 22. The purpose of the hem 22 is to reduce the chance that ticks, other arachnids or other insects will crawl beneath the chap 10 and onto the user's leg. The hem 22 preferably includes an elastic band sewn into the chap material 12. In this way, the hem 22 will fit snugly over the top of the boot, shoe, or sock of the user. Instead of an elastic band, the hem 22 could be formed with ties or Velcro, so long as the bottom of the chap 10 is brought snugly against the clothing of the user.

A flap 24 is formed in the chap material 12 by a seam 26. As seen best in FIG. 3, the flap 24 tends to hang downward when the user is standing, thus forming a crevice 28 below the seam 26. The flap 24 has an outer face 30 that terminates in a free end 32. The downwardly slanting outer face 30 creates a protected area 34 that is located just below the crevice 28. The protected area 34 is normally shielded from view (protected area 34 not seen in FIGS. 1 and 2).

The flap 24 impedes upward movement of ticks on the chap 10. Because ticks generally crawl only upward, movement of ticks will be halted in crevice 28 formed below the seam 26. Preferably, the flap 24 is formed relatively close to the top of the chap 10 because most ticks are initially picked up below knee level. This insures that the vast majority of ticks contacting the chap 10 will encounter the flap 24 during any upward movement. This also provides the greatest amount of surface area below the flap 24 on which the user may see a tick on the chap 10.

A gap 36 is formed between the protected area 34 and the free edge 32 of the flap 24. The gap 36 is required to prevent ticks from bypassing the crevice 28 and crawling directly onto outer face 30 of the flap 24. The flap 24 also creates a tight restricted area between the protected area 34 and the flap 24. Ticks generally tend to congregate in such tight restricted areas. Thus, the upward movement of the tick will be halted when the tick enters this restricted area.

Figure 4:
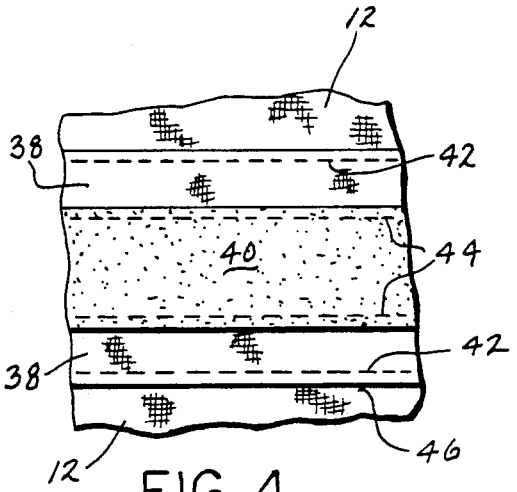
FIG. 4 is an view in vertical section taken along line 4—4 of FIG. 3.
Figure 3:
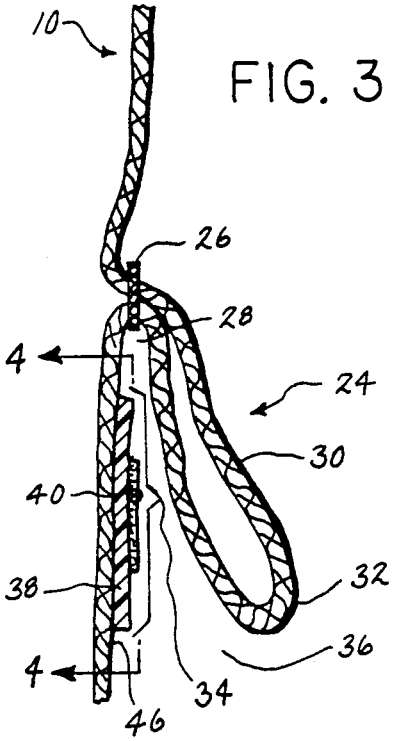
FIG. 3 is an enlarged view in vertical section taken along line 3—3 of FIG. 2.

As shown in FIGS. 3 and 4, the chap 10 also includes an impervious strip of material 38 and an absorbent strip of material 40. The impervious strip 38 is sewn at seams 42 onto the chap material 12, so that it encircles the thigh portion of the chap 10. The impervious strip 38 is located in the protected area 34, beneath the flap 24. The narrower absorbent strip 40 is sewn to the impervious strip 38 and the underlying chap material 12 at seams 44. The type of stitching used in seams 42 and 44 can affect upward movement of ticks on the chap 10. A straight stitch at seam 42 will cause a mini-gap between the impervious strip 38 and the chap material 12. A straight stitch at seam 44 will also cause a mini-gap between the absorbent layer and the impervious layer. Each mini-gap impedes upward movement of ticks and creates a tight area where ticks tend to congregate.

The narrower strip 40 can be made from numerous absorbant fabrics. The absorbency enables the user to apply a repellent to the strip. The absorbent strip 40 retains the repellent and any ticks crawling over the strip 40 would then contact the repellent. The absorbent strip 40 is also preferably somewhat elastic. When the absorbent strip 40 is sewn to the impervious strip 38 and the underlying chap material 12, the elasticity causes the protected area 34 to be drawn slightly inward. This in turn causes the flap 24 to bow slightly outward, thereby creating the gap 36. As stated previously, the gap 36 assures that ticks will not bypass the crevice 28 by crawling onto the free edge 32 of the flap 24. When repellent is applied to absorbent strip 40, the gap 36 assures that upward-moving ticks will come into contact with the repellent.

The wider impervious strip 38 beneath the absorbent strip 40 prevents repellent on the absorbent strip 40 from contacting the chap material 12. This prevents the repellent from seeping through to the pant leg of the user. The material for the impervious strip 38 can be a plastic coated fabric.

To use the chap 10, the user would slide the chap (top end first) over one leg of the user's pants. The user's foot should protrude beneath the bottom of the chap 10. The ties 20 are then attahed to the belt or belt loop of the user. If boots are worn, the hem 22 should fit snugly over the top of the boot. Otherwise, the hem 22 should be positioned over socks or the top of the user's shoe. A second chap 10 should be worn on the user's other leg in the same manner.

The chaps 10 according to the invention will aid the user in preventing ticks, other arachnids, and crawling insects from reaching the user's skin, whether or not the chaps are used with repellent applied to the absorbent strip 40. When no repellent is used, the chaps 10 used in the manner described above will still protect the user's body from ticks. The hem 22 will prevent ticks from going beneath the user's clothing between the footwear and the chap 10. The smooth chap material 12 will also aid the user by providing a surface not conducive to supporting the tick. The portion of the chap 10 between the flap 24 and the hem 22 also provides a smooth, bright surface on which ticks may be seen. The flap 24 impedes upward movement of ticks. Also, ticks must crawl over the impervious strip 38 and the absorbent strip 40 to continue in an upward direction. As noted earlier, the stitching of seams 42 and 44 may cause the strips 38 and 40 to bend out slightly, in which case a tick would encounter another barrier to upward movement.

Ticks continuing to move upward would further encounter crevice 28. Crevice 28 provides a complete barrier to upward movement of the tick when the chap 10 is in the normal upright position. The crevice 28 also provides a tight restricted area wherein ticks would generally congregate. Thus, even without the application of a repellent to absorbent strip 40, the chap 10 provides the user with a series of protections from ticks, other arachnids, and crawling insects.

for a user who wishes to use a tick repellent, the user need only apply the repellent to the absorbent strip 40. The impermeable strip 38 beneath the absorbent strip 40 prevents the repellent from soaking into the chap material 12 and then contacting the user's clothing and skin beneath the chap 10. In addition to the the benefits noted above, the chap design benefits the user by forcing ticks to crawl over the absorbent strip 40. The flap 24 extends the amount of time ticks spend between the protected area 34 and the flap 24, and thereby the amount of time ticks are near the repellent-ladened absorbent strip 40.

Use of the chaps 10 in this manner allows a user to employ a tick repellent without having to apply the substance to the user's skin or normal clothing. The absorbent strip 40 also reduces the area to which repellent must be applied, while providing the user with a greater degree of protection. The flap 24 shields the absorbent strip from general contact with the user, such as by brushing a hand or arm against the chap 10. Also, the flap 24 protects the repellent from enviromental exposure, such as to wind and rain. In this regard, the length of the flap 24 is such that the free edge 32 extends beneath the position of the bottom of the impervious strip 38. The repellent will therefore remain on the absorbent strip 40 longer, thus necessitating fewer reapplications.

The foregoing detailed description has been for the purpose of illustration. Thus, a number of modifications and changes may be made without departing from the spirit and scope of the present invention. For example, the chap material 12 could itself be made impermeable, and thus the separate impermeable strip 38 would not be required. Likewise. the subject matter of the invention can be applied to other articles of clothing, such as pants, coveralls, jackets, shirts, belts, arm bands, etc. Therefore, the invention should not be limited by the specific embodiment described, but only by the claims.

I claim:

1. A protective article of clothing for a leg, comprising:

a sheet of fabric adapted to encircle the leg, said sheet of fabric having a top portion and an opposite bottom portion;

a circumferential flap located on the sheet of fabric between said top and bottom portions;

means adjacent said bottom portion of said sheet of fabric for drawing said sheet of fabric around the leg;

means adjacent said top portion of said sheet of fabric for maintaining said sheet of fabric on the leg; and an absorbent strip attached circumferentially on said sheet of fabric between said top and bottom portions, said absorbant strip for receiving an insect repellent and being positioned below said flap so that said flap is positioned outward of said absorbant strip.

2. The protective article of clothing for a leg of claim 1, further comprising an impervious strip attached circumferentially on said sheet of fabric between said sheet of fabric and said absorbant strip.

3. The protective article of clothing for a leg of claim 1, wherein said means for maintaining said sheet of fabric ob the leg is a tie.

4. The protective article of clothing for a leg of claim 1, wherein said flap bows outward forming a gap between said flap and said sheet of fabric.

5. A protective article of clothing for a leg, comprising:

a sheet of fabric adapted to encircle the leg, said sheet of fabric having a top portion and an opposite bottom portion;

a circumferential flap located on the sheet of fabric between said top and bottom portions;

means adjacent said bottom portion of said sheet of fabric for drawing said sheet of fabric around the leg;

means adjacent said top portion of said sheet of fabric for maintaining said sheet of fabric on the leg; and an absorbent strip attached circumferentially on said sheet of fabric between said top and bottom portions, said absorbant strip positioned below said flap so that said flap is normally positioned outward of said absorbant strip; wherein said absorbant strip is slightly elastic and creates a gap between said absorbant strip and said flap.

6. A protective article of clothing for a portion of a user's body, comprising:

a sheet of fabric adapted to cover the portion of the body, said sheet of fabric having a top portion and an opposite bottom portion;

a circumferential flap located on the sheet between said top and bottom portions;

means adjacent said bottom portion of said sheet of fabric for drawing said sheet of fabric around the portion of the body;

means for maintaining said sheet of fabric on the portion of the body; and an absorbent strip attached circumferentially on said sheet of fabric between said top and bottom portions, said absorbant strip for receiving an insect repellent and being positioned below said flap so that said flap is positioned outward of said absorbant strip.

7. The protective article of clothing for a portion of a user's body of claim 6, further comprising an impervious strip attached circumferentially on said sheet of fabric between said sheet of fabric and said absorbant strip.

8. A protective article of clothing for a portion of a user's body of claim 6, wherein said flap bows outward forming a gap between said flap and said sheet of fabric.

9. A protective article of clothing for a portion of a user's body, comprising:

a sheet of fabric adapted to cover the portion of the body, said sheet of fabric having a top portion and an opposite bottom portion;

a circumferential flap located on the sheet of fabric between said top and bottom portions;

means adjacent said bottom portions of said sheet of fabric for drawing said sheet of fabric around the portion of the body;

means for maintaining said sheet of fabric on the portion of the body; and an absorbent strip attached circumferentially on said sheet of fabric between said top and bottom portions, said absorbant strip positioned below said flap so that said flap is normally positioned outward of said absorbant strip; wherein said absorbant strip is slightly elastic and creates a gap between said absorbant strip and said flap.

* * * * *